United States Patent [19]

Weiskopf

[11] 4,026,176

[45] May 31, 1977

[54] MEANS FOR SETTING SLITTER HEADS

[75] Inventor: Gunther Weiskopf, New York, N.Y.

[73] Assignee: S&S Corrugated Paper Machinery Co., Inc., Brooklyn, N.Y.

[22] Filed: Oct. 20, 1975

[21] Appl. No.: 623,822

Related U.S. Application Data

[63] Continuation-in-part of Ser. No. 456,012, March 29, 1974, Pat. No. 3,951,024.

[52] U.S. Cl. ..... 83/502; 83/504; 83/582

[51] Int. Cl.[2] ..... B26D 1/24

[58] Field of Search ..... 83/501, 502, 504, 582

[56] References Cited

UNITED STATES PATENTS

| | | | |
|---|---|---|---|
| 1,525,590 | 2/1925 | Perrault | 83/501 |
| 3,173,325 | 3/1965 | Warren et al. | 83/501 X |
| 3,730,043 | 5/1973 | Zimmermann | 83/502 |
| 3,899,948 | 8/1975 | Jakob | 83/502 X |

*Primary Examiner*—Frank T. Yost

*Attorney, Agent, or Firm*—Ostrolenk, Faber, Gerb & Soffen

[57] ABSTRACT

Slitting apparatus for trimming the edges of a web of corrugated board and longitudinally cutting the web into a plurality of narrow webs is constructed with selectively operable fluid operated means that clamps the working heads in adjusted positions along the length of their respective drive shafts. The fluid operated means includes a plurality of spring steel pressure bars extending parallel to the length of each shaft and disposed within different grooves thereof, with each pressure bar being operatively positioned to clamp a plurality of heads in operating positions by engaging keys secured to these heads. The keys extend beyond the faces of the heads and for each of the heads include notches that provide clearance for the extending portions of the keys secured to adjacent heads. The drive shafts are parallel to each other, and one of these shafts is longitudinally movable after the heads are locked in place so that the knives mounted thereon positively mate with or engage cooperating knives on the other shaft.

8 Claims, 7 Drawing Figures

10
11
12
13
14
15a
15b
16a
16b
17a
17b
18a
18b
19a
19b
20a
20b
21a
21b
22a
22b
23a
23b
2
50
51

11
16a
24
25
26
27
28
29
31
32
33
34
39
50
52
53
54
61a 11
14
26
29
33
34
35
36
37
38
39
41
42
43
44
45
46
47
48
52
81
82
83

MEANS FOR SETTING SLITTER HEADS

This application is a continuation-in-part of my copending U.S. application Ser. No. 456,012 filed Mar. 29, 1974, and issued Apr. 20, 1976 as U.S. Pat. No. 3,951,024.

This invention relates to rotary slitting apparatus and more particularly relates to apparatus of this type having selectively operable fluid operating means to lock a plurality of slitter heads in adjusted position on their respective drive shafts.

In the production of double-faced corrugated board, the wide web of corrugated board produced by the double-backer passes through a heating section into a pulling or cooling section, and then passes through slitting apparatus which trims the edges of the wide web. Thw slitting apparatus comprises a pair of transversely extending drive shafts having sets of slitting heads adjustably mounted thereon. These heads cut the web longitudinally to form a plurality of relatively narrow webs. Very often the apparatus also includes scoring heads which apply longitudinally extending scores to these webs.

In one form of prior art slitter apparatus, repositioning of the heads on their drive shafts requires the operator to unlock the screw clamped heads individually, move each of the heads to its new position, and then individually screw-clamp each head at its new position. In accordance with the instant invention, fluid pressure is utilized to selectively lock and unlock all of the slitter heads simultaneously.

The pneumatic locking means includes a plurality of locking bars each of which is disposed within a longitudinally extending shaft slot and is associated with an inflatable hose. When the hose is subjected to internal pressure, it expands and drives the locking bar into clamping engagement with a plurality of keys each mounted to an individual head. The locking bars are deflectable, so as to engage extensive areas of the keys and to insure that manufacturing tolerances are not able to gang up to defeat the purpose of the locking bar. Further, the deflectable nature of the locking bar enables it is firmly engage three or more keys.

Accordingly, a primary object of the instant invention is to provide novel gang locking means for the working heads of slitting apparatus.

Still another object is to provide rotary slitting means having fluid operating means for gang locking the heads in their operative positions on the support shafts.

Another object is to provide apparatus of this type in which the gang locking means includes flexible locking bars.

Still another object is to provide apparatus of this type in which retaining means for the pressure bar is constructed to provide a guideway wherein keys secured to the working heads are disposed.

A further object is to provide apparatus of this type having means for moving tools on one shaft into operative engagement with tools on the other shaft after the heads are secured in operative positions on these shafts.

These objects as well as other objects of this invention will beocme readily apparent after reading the following description of the accompanying drawings in which.

Figure 6:
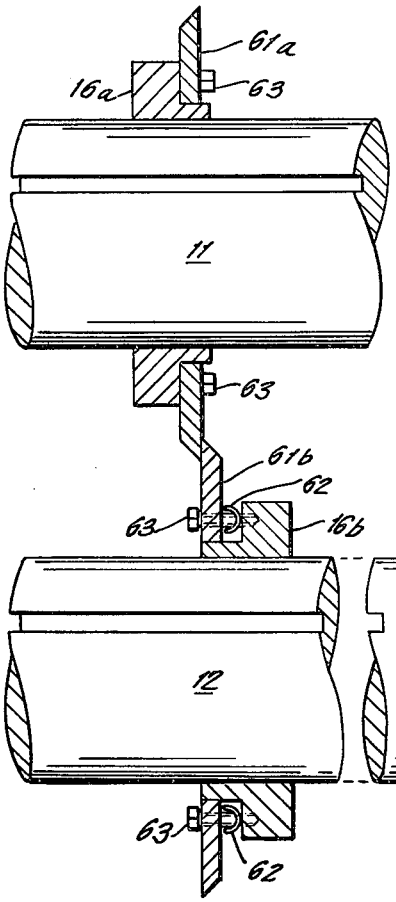
Figure 7:
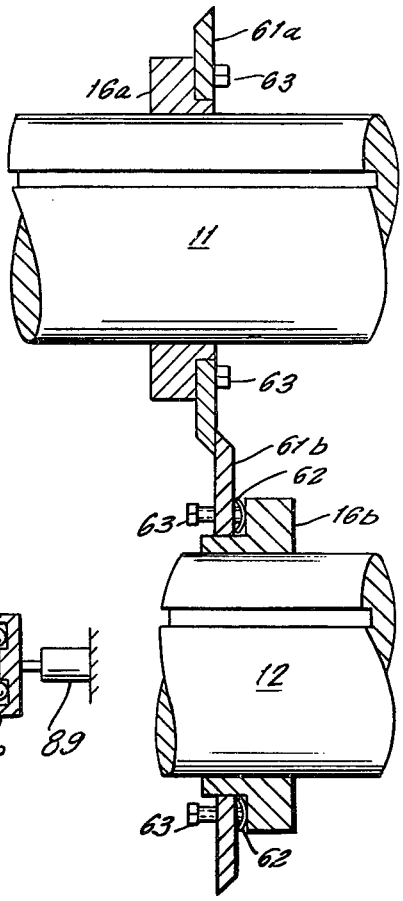
Figure 7:
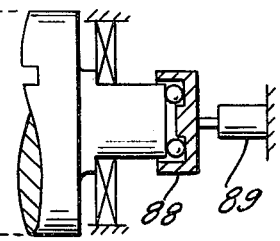

FIGS. 6 and 7 are fragmentary cross-sections illustrating a feature of the instant invention which provides means for operatively engaging cooperating knife blades after their heads are securely clamped to the drive shaft. In FIG. 6 the drive shafts are shown in head adjusting position immediately after head clamping, and in FIG. 7 the heads are shown after relative movement of the drive shafts to their working positions.

Figure 1:
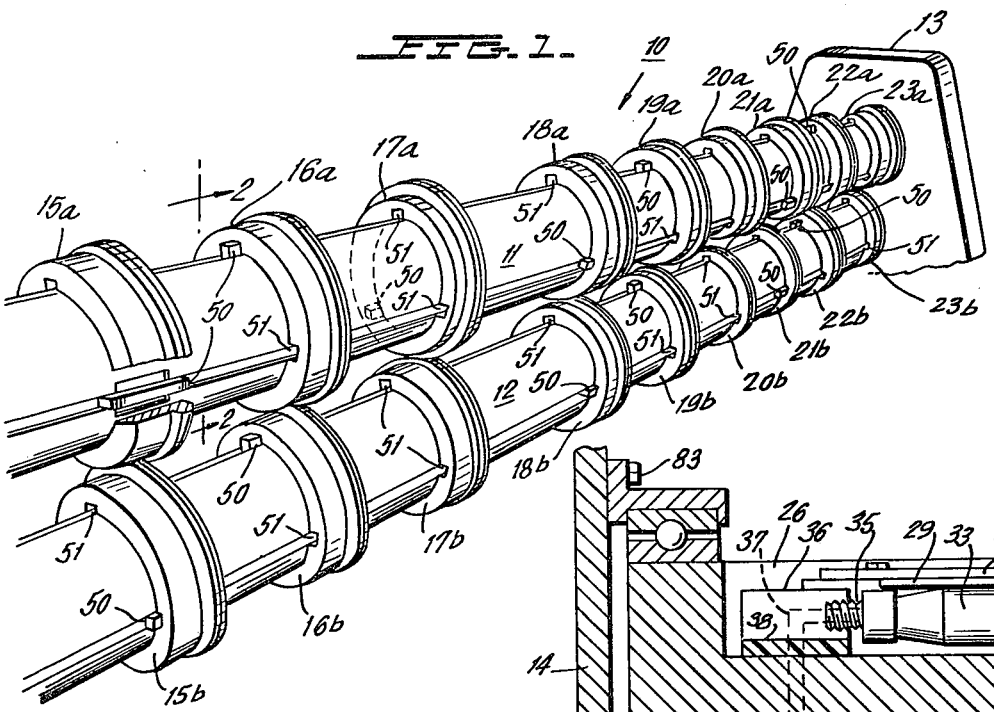
FIG. 1 is a fragmentary perspective of rotary slitting apparatus constructed in accordance with teachings of the instant invention.
Figure 3:
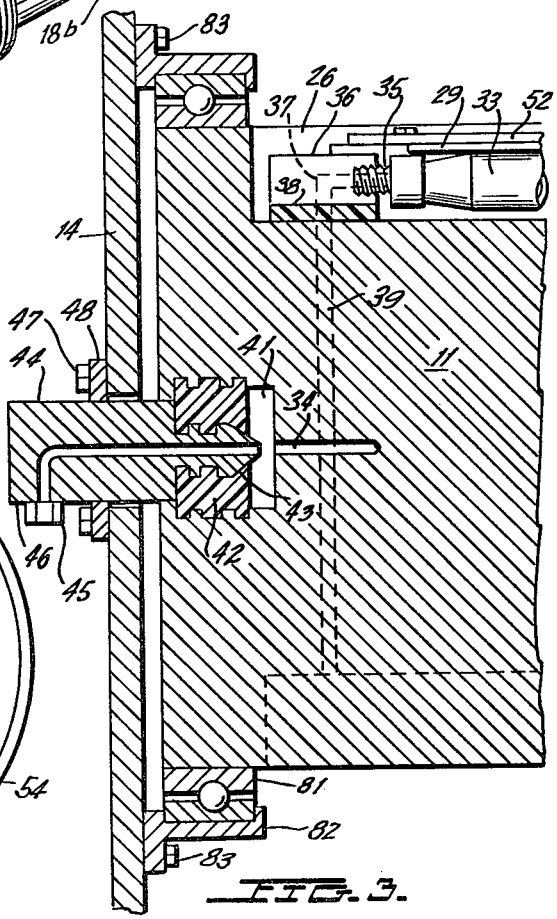
FIG. 3 is a fragmentary cross-section through a diameter of one of the slitter shafts at the end thereof having a rotary fluid coupling.

Now referring to the figures. The rotary slitting apparatus indicated generally by reference numeral 10 in FIG. 1 includes parallel upper and lower drive shafts 11, 12 having their ends supported by vertical frame members 13, 14 (FIG. 3). Drive shafts 11, 12 extend transverse to the direction of travel of web material, such as corrugated board, that passes between shafts 11, 12 and is operated upon by the tools mounted on shafts 11, 12. Shaft 11 mounts a plurality of tool supporting heads **15*a*–23*a*, and shaft 12 mounts another plurality of tool carrying heads 15*a* –23*b*. As is well known to the art, the tools on each pair of opposed heads cooperate to either longitudinally slit, score, or slot a web traveling along a feed path in the space between drive shafts 11, 12.**

Figure 2:
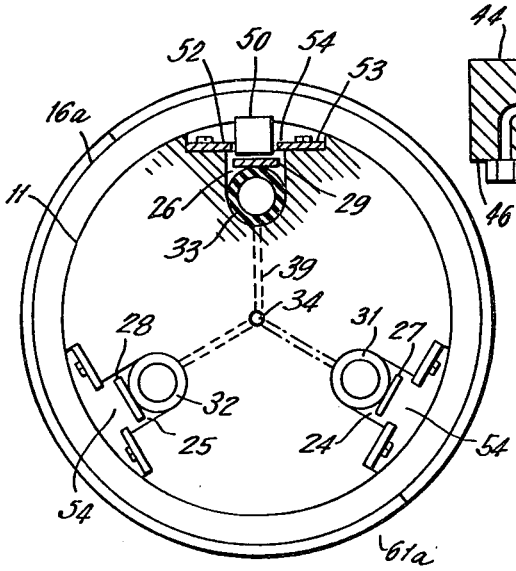
FIG. 2 is a cross-section taken through line 2—2 of FIG. 1 looking in the direction of arrows 2—2.

As seen in FIG. 2, shaft 11 is provided with three longitudinally extending slots 24–26 spaced 120° apart. Pressure bars 27–29 are disposed respectively within slots 24–26. Also disposed within slots 24–26 but positioned inboard of bars 27–29 are the respective inflatable hoses 31–33. For substantially the full length of each of the slots 24–26 and along opposite sides thereof are a pair of strips 52, 53 that partially overlie the entrances to slots 24–26 and serve to retain pressure bar 27–29 within slots 24–26. All three hoses 31–33 are connected to axially extending passage 34 in shaft 11 by similar elements which will be described only in connection with hose 33.

More particularly, one end of hose 33 is clamped shut and the other end is provided with male coupling 35 threadably mounted to block 36 at one end of L-shaped passage 37 in block 36. The other end of passage 37 communicates with a hole in gasket 38 which is interposed between block 36 and the inboard boundary surface of slot 26, and this way communicates with radially extending passage 39 in shaft 11. Passage 39 communicates with axially extending passage 34. The latter passage 34 communicates with end chamber 41 wherein rotary packing seal 42 is disposed. The latter surrounds the formed end 43 at the right of block 44 with L-shaped passage extending through block 44 from end 43 to coupling 45 secured to block surface 46.

Block 44 extends through an aperture in frame 14 and is secured thereto by bolts 47 extending through collar 48 that is welded to block 44. The end of shaft 11 having chamber 41 is provided with bearing 81 which in turn is mounted to annular bearing support 82 that is secured by bolts 83 to frame member 14.

An individual key 50 is secured to each of the heads **15*a* –23*a* and 15*b*–23*b*. Keys 50 is secured to each third head are disposed within slot 26. The confronting edges of strips 52, 53 are spaced apart to form guideway 54** within which keys 50 travel. A different set of keys 50 secured to different heads, also spaced apart by two heads, are entered into slot 25, and keys 50 secured to the remaining heads are entered into slot 24. Notches or cutouts 51 extending through heads 15*a*–23*a*, 15*b*–23*b* from side to side thereof provide clearance recesses to receive the end portions of keys 50 on adjacent heads so that the heads 15*a*–23*a*, 15*b*–23*b* may be moved very close to each other.

It is noted that lower shaft 12 is provided with essentially the same gang lockings means for heads 15*b*–23*b* as the gang locking means for heads 15*a* –23*a* mounted on upper shaft 11.

Slitter apparatus 10 is utilized by initially relaxing pressure within hoses 31—33 of both upper and lower drive shafts 11, 12. Heads 15*a*–23*a*, 15*b*–23*b* are moved to selected positions along the lengths of their respective drive shafts 11, 12. High pressure air is then introduced at coupling 45 to inflate all of the hoses 31–33, causing them to expand and drive pressure bar 27–29 into firm engagement with keys 50 to produce clamping forces which prevent movement of heads 15*a*–23*a*, 15*b*–23*b* along shafts 11 and 12.

Figure 4:
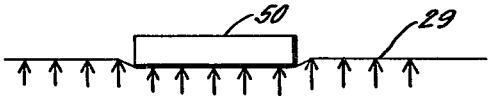
FIGS. 4 and 5 are diagrams used for explanation of operating principles of the instant invention.

Pressure bars 27–29 are constructed of spring steel so that each bar 27–29 is neither completely stiff nor completely flexible. If pressure bars 27–29 were completely flexible, they could not control expandable hoses 31–33 and the force applied to each key 50 would only be a function of the area of a hose 31–33 under particular key 50. By using a stiff yet flexible pressure bar, hose portions extending in a longitudinal direction with respect to the drive shaft contribute to the clamping force acting on the key 50. That is, the upward force of each hose 31–33, indicated by the upwardly pointing arrows in FIG. 4, is transmitted to some extent to each key 50 through a pressure bar 26–29. The total force applied by the expandable hose to key 50 is also increased by having the length of each key 50 considerably greater than the thickness of each head.

Figure 5:
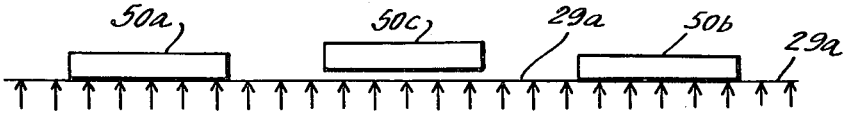

The use of a very rigid pressure bar is undesirable when more than two heads are to be locked by each pressure bar. That is, because of normal manufacturing tolerances, it is possible that with three keys 50 in one slot, the two outer keys 50*a*, 50*b* (FIG. 5) may extend farther into the keyway than the center key 50*c*. If the pressure bar 29*a* were very rigid, all of the locking force would be applied to the outer heads and none of the locking force would be applied to the center head since pressure bar 29*a* would be too rigid to deflect and engage center key 50*c*. However, if pressure bar 29*a* is replaced by bar 29 in FIG. 5, bar 29 will deflect upward between keys 50*a*, 50*b* and engage keys 50*c* so that sufficient clamping forces are applied to all three keys 50*a*, 50*b*, 50*c*.

As seen in FIG. 6, split blades 61*a*, 61*b* secured to heads 16*a*, 16*b*, respectively, cooperate with each other by being in operative engagement. For proper cutting, blade engagement must be under pressure. Thus, a plurality of relatively stiff leaf springs 62 are interposed between blade 61*b* and head 16*b* and are positioned to bias blade 61*b* toward blade 61*a*. All of the other slitter blades on lower shaft 12 are spring mounted in essentially the same manner as blade 61*b*. During the setup of slitter apparatus 10, when fluid pressure is applied to expandable hoses 31–33, heads 16*a*, 16*b* are locked in the positions shown in FIG. 6, so that blade 61*b* rests against the heads of its retaining screws 63. Further loading of spring 62 is accomplished by energizing power cylinder 89. The latter acts through thrust bearing unit 88 on the right end of shaft 12 thereby moving shaft 12 slightly to the left with respect to the position occupied by it in FIG. 6. This moves all of the heads 15*b*–23*b* to the left simultaneously thereby compressing springs 62 which increases the spring loading on the slitter blades mounted to each of the heads 16*b*–23*b*. For a construction in which tools are not spring loaded on their respective heads, after cooperating heads are brought into abutment, each of the heads on one drive shaft may be tapped by a manually or automatically operated hammer to move these heads slightly along the axis of their shaft to obtain pressure engagement between cooperating blades 61*a*, 61*b*. Of course, there are some tools, such as creasers, that do not require side loading.

Although in the foregoing there have been described preferred embodiments of this novel invention, may variations and modifications will now be apparent to those skilled in the art, and it is preferred therefore that the instant invention be limited not by the disclosure contained herein but only by the appending claims.

The embodiments of the invention in which an exclusive privilege or property is claimed are defined as follows:

1. Apparatus for longitudinally slitting a web traveling along a feed path, said apparatus including a drive shaft extending transverse to said path, first and second tool supporting heads mounted on said shaft for adjusting movement along the length of said shaft and to be rotated thereby, selectively operable locking means for maintaining said heads in adjusted positions along the length of said shaft while the latter rotates, another drive shaft parallel to said drive shaft, third and fourth tool supporting heads mounted on said another shaft for adjusting movement along the length of said another shaft and to be rotated thereby, another selectively operable locking means for maintaining said third and fourth heads in adjusted positions along the length of said another shaft while the latter rotates, first, second, third and fourth tools mounted on the respective first, second, third and fourth heads and rotatable therewith, a first and second plurality of retainers mounting the respective first and second tools to the respective first and second heads for relative axial movement therebetween, first and second biasing means for the first and second heads urging the latter in a first axial direction toward the respective third and fourth tools, said retainers including portions limiting relative axial movement in said first direction between said first and second tools and the respective first and second heads.

2. Apparatus as set forth in claim 1 also including means mounting said shaft and said another shaft for limited relative axial movement from a head adjusting position to a working position to bring said third and fourth tools and the respective first and second tools into final cooperating relationship.

3. Apparatus as set forth in claim 1 in which each of said retainers includes a screw and said portions include the heads of said screws.

4. Apparatus as set forth in claim 1 in which the first biasing means includes an individual spring each retained by an individual retainer of said first plurality of retainers, and said second biasing means includes an individual spring each retained by an individual retainer of said second plurality of retainers.

5. Apparatus as set forth in claim 4 also including means mounting said shaft and said another shaft for limited relative axial movement from a head adjusting position to a working position to bring said third and fourth tools and the respective first and second tools into final cooperating relationship.

6. Apparatus as set forth in claim 1 in which the first and second biasing means are partially loaded when axial movement of said first and second tools in said first direction is limited by said retainers.

7. Apparatus as set forth in claim 6 in which each of said retainers includes a screw and said portions include the heads of said screws.

8. Apparatus as set forth in claim 7 also including means mounting said shaft and said another shaft for limited relative axial movement from a head adjusting position to a working position to bring said third and fourth tools and the respective first and second tools into final cooperating relationship.

* * * * *